US005865549A

United States Patent [19]

Kinard et al.

[11] Patent Number: 5,865,549

[45] Date of Patent: Feb. 2, 1999

[54] APPARATUS FOR APPLYING A COATING TO A SUBSTRATE

[75] Inventors: Jimmy Kinard, Arkadelphia; Todd Corley, Bismarck; Timothy Kersy, Arkadelphia, all of Ark.; James Mollenhoff, Bedford; Michael Steele, Richardson, both of Tex.

[73] Assignee: Siplast, Inc., Arkadelphia, Ark.

[21] Appl. No.: 853,763

[22] Filed: May 9, 1997

[51] Int. Cl.[6] ..... A46B 11/00

[52] U.S. Cl. ..... 401/48; 239/170; 239/551; 239/566; 401/35; 401/137

[58] Field of Search ..... 401/48, 35, 137; 239/104, 146, 170, 551, 566

[56] References Cited

U.S. PATENT DOCUMENTS

| | | | |
|---|---|---|---|
| 1,083,030 | 12/1913 | Price | 239/170 X |
| 1,548,383 | 8/1925 | Pickersgill | 239/170 X |
| 1,971,262 | 8/1934 | Hendricks | 239/104 |
| 2,273,599 | 2/1942 | Smith et al. | 401/48 X |
| 2,666,323 | 1/1954 | Ames . | |
| 2,824,442 | 2/1958 | Ames . | |
| 3,023,970 | 3/1962 | Knoell | 239/566 X |
| 3,146,485 | 9/1964 | Evans et al. . | |
| 3,838,817 | 10/1974 | Hill | 239/551 X |
| 4,055,384 | 10/1977 | Palzer | 401/48 |
| 4,165,192 | 8/1979 | Mellen | 401/48 |
| 4,448,352 | 5/1984 | Jacobson, Jr. et al. | 239/170 X |
| 4,537,331 | 8/1985 | Matula | 401/48 X |
| 4,638,948 | 1/1987 | Marlek | 401/48 X |
| 4,653,424 | 3/1987 | Schloss et al. | 118/108 |
| 4,960,242 | 10/1990 | Larson | 239/170 X |
| 5,254,167 | 10/1993 | Janoski et al. | 401/48 X |
| 5,358,347 | 10/1994 | Morris | 401/48 |
| 5,366,308 | 11/1994 | Crispino | 401/48 X |
| 5,366,309 | 11/1994 | Springall | 401/48 |
| 5,419,647 | 5/1995 | Kirk et al. | 401/48 |

FOREIGN PATENT DOCUMENTS

| | | | |
|---|---|---|---|
| 1612 | 11/1912 | United Kingdom | 239/170 |
| 240544 | 10/1925 | United Kingdom | 239/146 |
| 614488 | 12/1948 | United Kingdom | 239/146 |

*Primary Examiner*—David J. Walczak
*Assistant Examiner*—Kathleen J. Prunner
*Attorney, Agent, or Firm*—Akin, Gump, Strauss, Hauer & Feld, L.L.P.

[57] ABSTRACT

A device for applying a fluid coating, including a feed tube assembly having a plurality of feed tubes and valves for controlling the flow of fluid through each of the tubes, an extrusion tube coupled to each feed tube, and a fluid spreader coupled to the spreader tube.

7 Claims, 8 Drawing Sheets

APPARATUS FOR APPLYING A COATING TO A SUBSTRATE

BACKGROUND OF THE INVENTION

1. Field of the Invention

The present invention relates to apparatuses for applying fluid coatings to substrates, and, in particular, for applying liquid adhesives to roofing materials.

2. Description of the Related Art

A variety of devices are known for applying coatings to substrates and particularly for applying roofing adhesives and asphalt. The simplest devices are hand held brooms and squeegees that can be used manually to spread such coatings. A variety of mechanical sprayers, spreaders and combinations thereof are also known.

In general terms, the known devices suffer from numerous drawbacks. Use of hand-held brooms, rollers and squeegees is particularly labor intensive. In addition, it is difficult to obtain a substantially uniform coating using such hand-held devices. Sprayers may cause over-spray, particularly in windy conditions often found on roof tops. Some known spreaders are overly complex which makes them expensive and difficult to maintain. Other known spreaders are too inflexible to be adapted to a variety of substrates or coating specifications.

With respect to the installation of bituminous roof membranes, it is particularly important that the adhesive coating be applied in a substantially uniform and consistent layer to ensure proper adhesion of the bituminous roofing sheets. This is difficult to accomplish quickly and inexpensively with known devices and methods.

Accordingly, it is an object of this invention to overcome the disadvantages and drawbacks of the known art and to provide simple, inexpensive, adaptable and reliable apparatuses for applying coatings to substrates, particularly roofing coatings and adhesives to roof tops.

Further objects and advantages of this invention will become apparent from a detailed description of a preferred embodiment which follows.

SUMMARY OF THE INVENTION

The present invention is directed to a device for applying a fluid coating, comprising: (a) a feed tube assembly comprising a plurality of feed tubes and valves for controlling the flow of fluid through each of the tubes; (b) an extrusion tube coupled to each feed tube; and (c) a fluid spreader coupled to the spreader tube.

The present invention is directed to a device for applying a fluid coating, comprising (a) means for spreading the fluid; and (b) means for channelling the fluid from a fluid source to the spreader means, wherein: the channeling means comprises a plurality of feed tubes and means for controlling the flow of fluid through each of the tubes; the spreading means comprises, means for dispensing fluid from the tubes and means for spreading the dispensed fluid in a substantially uniform layer; the dispensing means is compartmentalized.

Accordingly, the present invention offers many advantages over the known art. Apparatuses in accordance with the present invention are relatively inexpensive and easy to construct, assemble and maintain. They are also highly efficient, as they enable a single user to coat a large surface area in a relatively short period of time. In addition, they enable a relatively unskilled user to apply a consistent and uniform coating to a substrate, thereby decreasing costs and improving quality. They also have greater flexibility than known devices as they permit controlled variable distribution of fluid.

DESCRIPTION OF THE PREFERRED EMBODIMENTS

Figure 1:
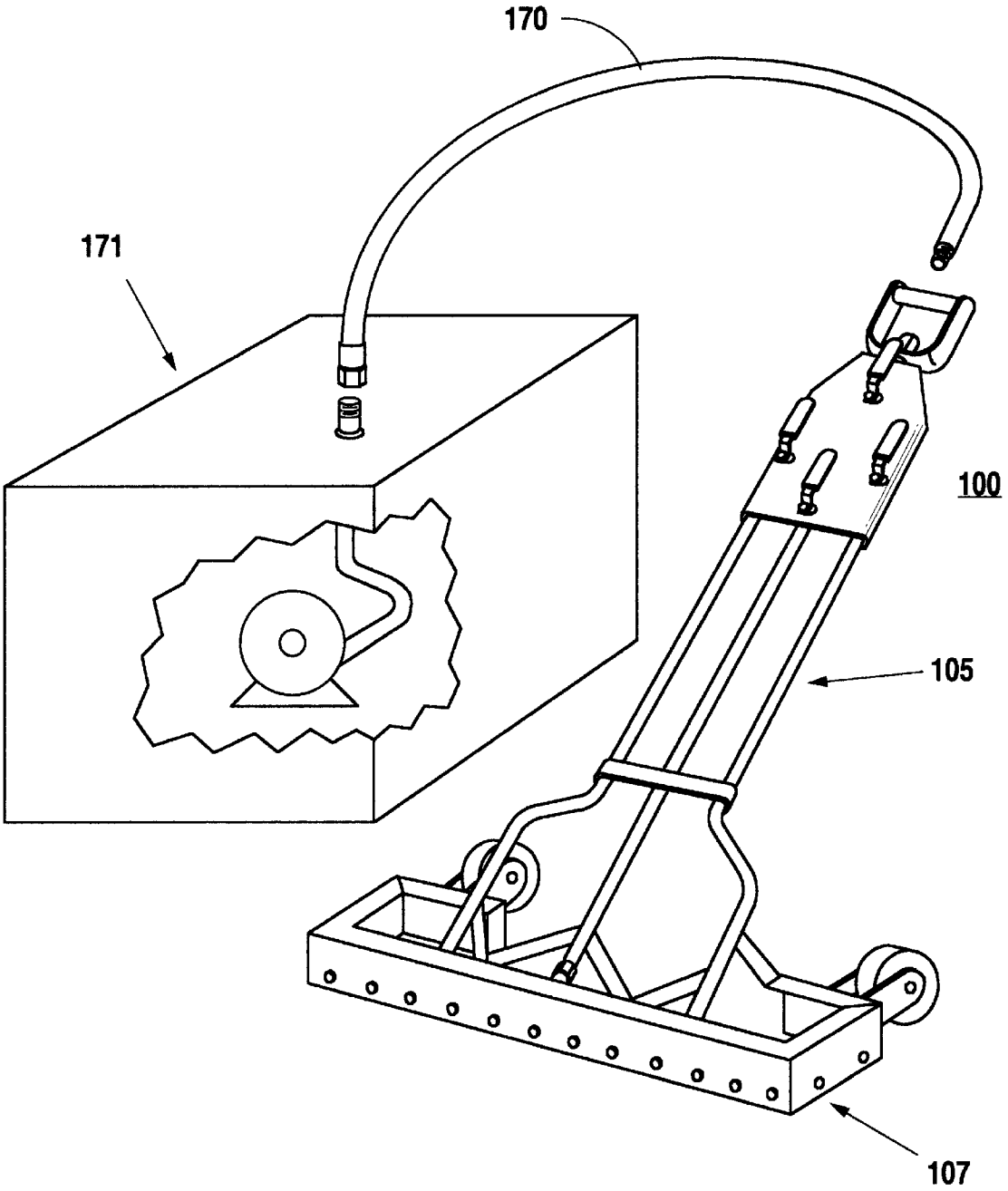
FIG. 1 shows a perspective view of a coating applicator in accordance with a preferred embodiment of the present invention.
Figure 2:
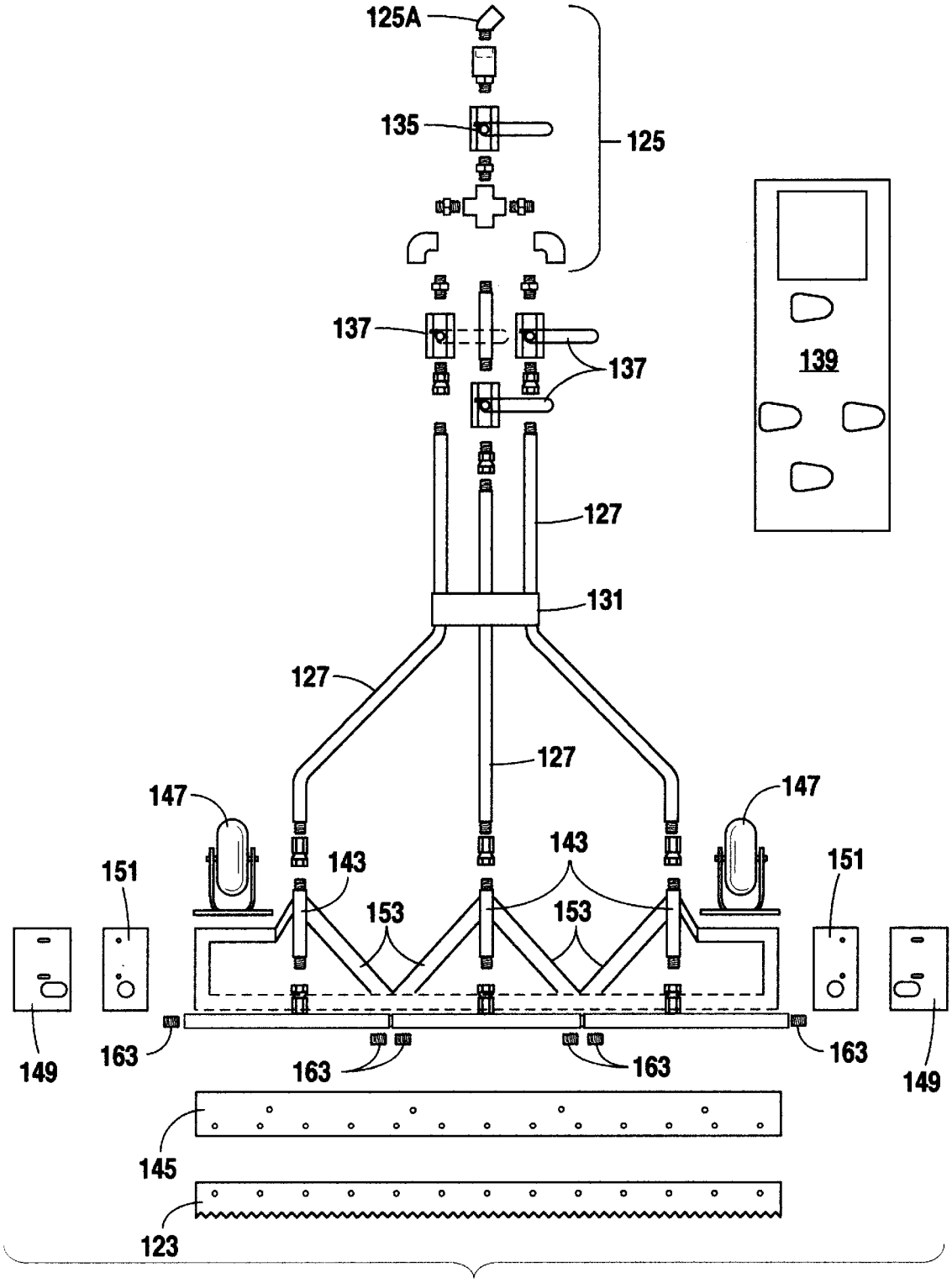
FIG. 2 shows an exploded schematic view of a coating applicator in accordance with a preferred embodiment of the present invention.

Referring now to FIGS. 1 and 2, there is shown a device 100 for applying fluid coatings to substrates. As used herein, a fluid coating is any composition in a fluid form that may be applied to a substrate. The device 100 is particularly adapted for applying roofing adhesives, particularly cold process bituminous adhesives, to substantially flat roof surfaces, particularly bituminous roof membrane components. As will become apparent from the description, however, the device 100 could also be used to apply many other fluid coatings, including, without limitation, asphalts, sealers, paints, and the like to a variety of substrates.

The device 100 comprises a feed tube assembly 105 and an extrusion assembly 107.

Figure 3:
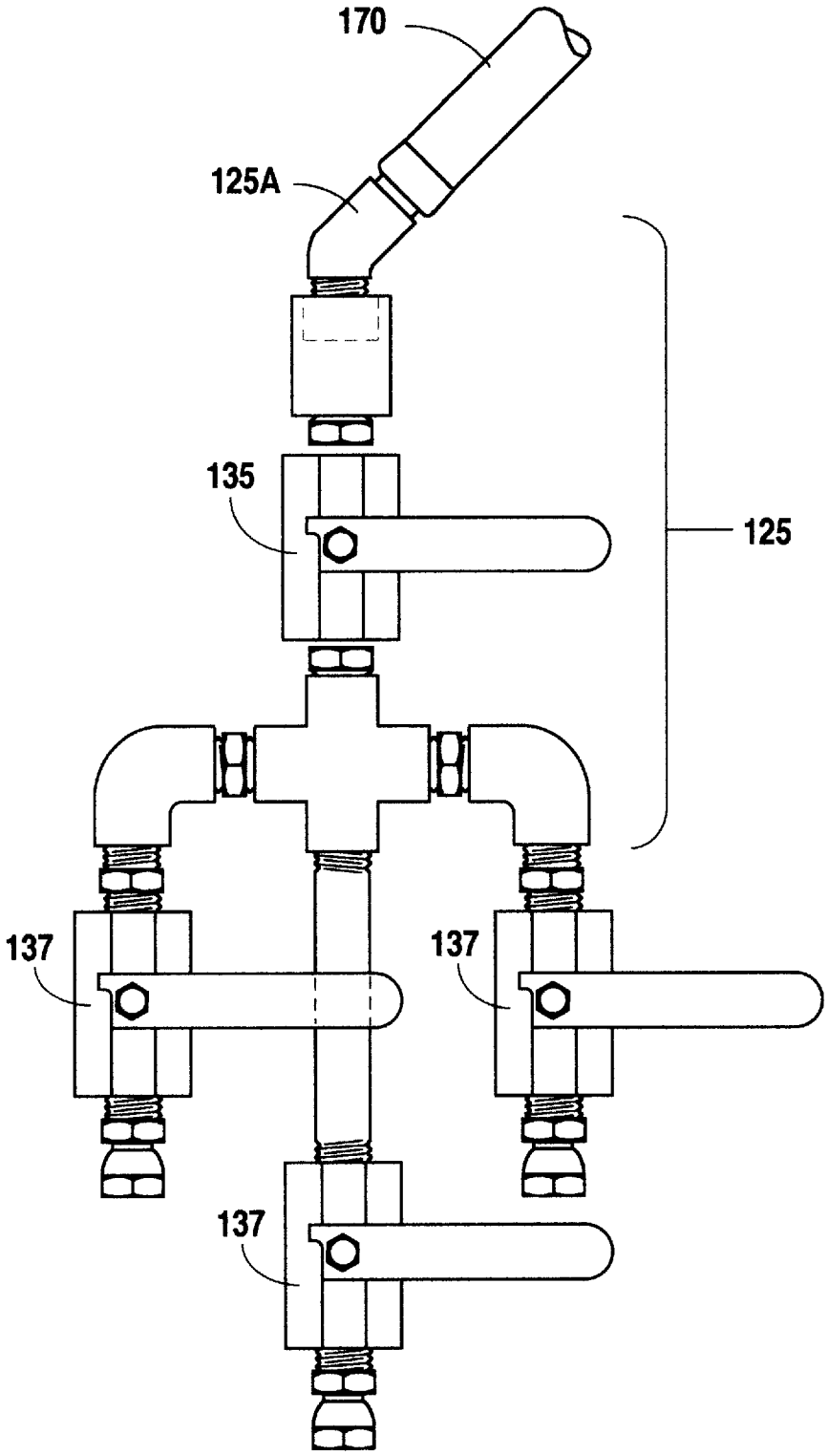
FIG. 3 shows an enlarged top view of a valve assembly portion of a coating applicator in accordance with a preferred embodiment of the present invention.

Referring now to FIGS. 1–4, the feed tube assembly 105, preferably comprises a source tube connector 125, a main valve 135, a plurality of feed tubes 127 and a plurality of secondary valves 137. The source tube connector 125 preferably couples the device 100 to a hose 170 which is in turn connected to a fluid source 171. The fluid source has a pump 172 or other means of providing the fluid to the device 100 under pressure. The source tube connector 125 comprises suitable connectors and adapters, as best shown in FIGS. 2 and 3. The size and configuration of the adapters and connectors depends on the number and size of the source tube(s) and feed tubes 127. Notably, connector 125*a* is preferably a swivel to permit rotation of the device 100 without twisting the source tube. The source tube connectors 125 also comprise a main valve 135 to regulate the flow of fluid from the hose 170 to the feed tubes 127.

While the size and configuration of the device 100 can vary substantially within the scope of the invention, a preferred size and configuration of the device 100 permits a single operator to use the device 100. Accordingly, a preferred embodiment of the present invention has one source tube connector 125 and from 2 to 5 feed tubes 127, and, most preferably, 3 feed tubes 127. The preferred number of feed tubes 127 depends upon the desired width of the surface to be covered with a single pass of the device 100 and the viscosity of the fluid to be applied. The feed tubes 127 are designed to be detachable to allow for easy clean-up and storage. The tubing for the feed tubes 127 is preferably a rigid, durable tubing of sufficient strength to safely withstand the pressure in the system. In a preferred embodiment of the present invention, the tubing is cold roll steel tubing of about 0.2 to 0.3 inches wall thickness, with an outside diameter of about 0.75 to 1.0 inches and an inside diameter of about 0.5 to 0.625 inches. Rigid tubing is preferred because it provides a structural connection to the extrusion assembly 107. If some form of flexible tubing is used an external structure (not shown) is necessary. Even with rigid tubing, a cross-piece 131 may be used to provide additional support and torsional rigidity to the device 100.

The flow of fluid through the feed tubes 127 is regulated by secondary valves 137. The main valve 135 and the secondary valves 137 are adapted to accommodate the pressures in the system, and are preferably ball type valves.

Figure 10A:
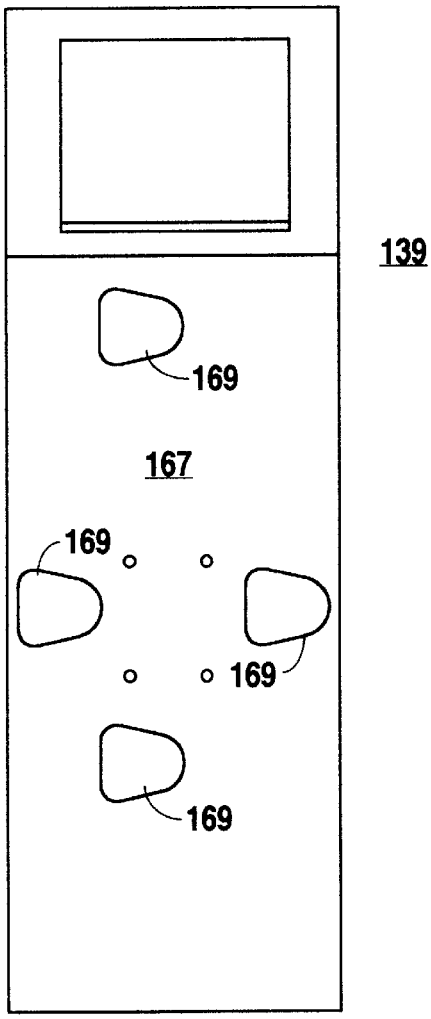
FIGS. 10A–10B show front and side views, respectively, of a valve cover plate in accordance with a preferred embodiment of the present invention.
Figure 10B:
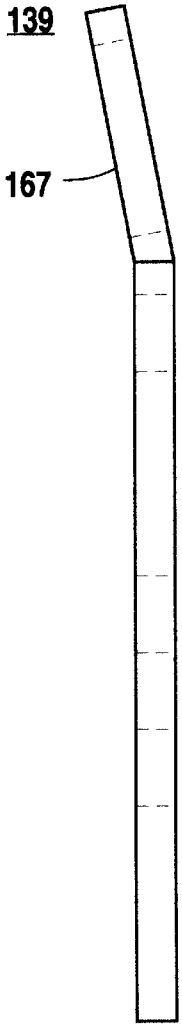
Figure 11A:
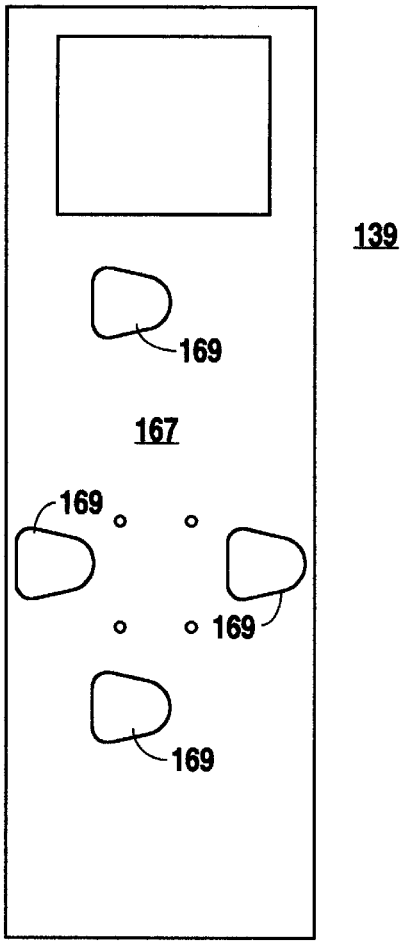
FIGS. 11A–11B show front and side views, respectively, of a valve cover plate in accordance with an alternative preferred embodiment of the present invention.
Figure 11B:
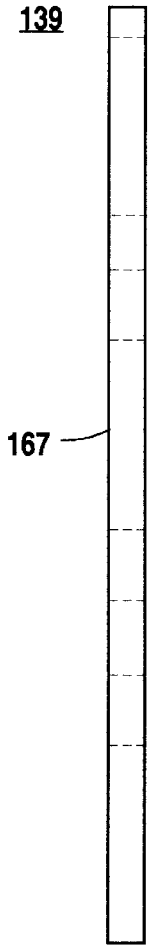
Figure 12A:
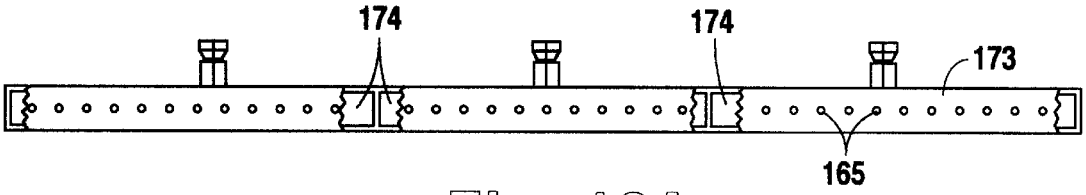
FIG. 12A shows a bottom view of the single extrusion tube of a coating applicator in accordance with an alternate embodiment of the present invention.
Figure 12B:
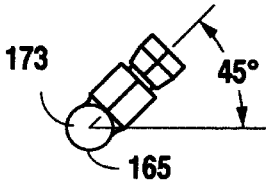
FIG. 12B shows a side view of the single extrusion tube of a coating applicator in accordance with an alternate embodiment of the present invention.

Referring now to FIGS. 1, 2, 10A–10B and 11A–11B, the valves 135 and 137 are preferably covered with a cover plate 139. The cover plate 139 is preferably a solid plate with a plurality of valve access holes 169 therethrough adapted to permit access to and operation of the handles of the valves 135 and 137. The cover plate 139 serves safety, cosmetic and informational functions. The cover plate 139 shields the user from the source tube connector 125 components while hiding those components from view. The cover plate 139 may also be extended below the secondary valves 137 allowing space to provide safety and instructional information. The cover plate 139 may also be extended above the valves to provide a convenient handle 167 by which the user can manipulate the device 100. As shown in FIG. 10B, in a preferred embodiment, the handle 167 of the cover plate 139 is at a slight angle from the valve cover portion of the cover plate 139. In an alternative preferred embodiment, as shown in FIG. 11B, the cover plate 139 is straight. The latter configuration permits more clearance for the handle of the main valve 135.

Referring now to FIGS. 1, 2 and 5–12, the feed tube assembly 105 is coupled to an extrusion assembly 107. The extrusion assembly 107 comprises a frame 141, extrusion pipe(s) 121, feed tube connectors 143, squeegee 123, squeegee clamp 145, side shields 149, side plates 151 and wheels 147.

The frame 141 is adapted to support the feed tube assembly 105 in a stable upright position. The feed tube assembly 105 is coupled to the frame 141 at an angle comfortable to the user, preferably about 30 to 40 degrees from horizontal. In a preferred embodiment of the present invention, the angle of attachment is adjustable to accommodate different size users. While the size of the frame 141 can vary greatly within the scope of the present invention, where the intended use is by a single operator for spreading cold process bituminous adhesives, the interior of the frame 141 is preferably about 4 inches wider than the standard roofing roll, or about 39 to 41 inches wide, 5 to 6 inches deep and 3 to 4 inches high. The frame 141 may be made of any suitably rigid and durable material and is preferably made of steel.

The frame 141 also comprises support members 153 to provide additional support and rigidity to the frame 141 and the feed tube assembly 105. Feed tube connectors 143 are coupled, preferably welded, to the support members 153. The feed tube connectors 143 are removably coupled to the feed tubes 127 and the extrusion tube(s) 121, by suitable connectors.

Back plates 161 are coupled to the leading edge of the frame 141. Wheels 147 are coupled to the frame 141 by back plates 161 such that the bottom edge of the frame 141 is about 0.375 to 0.75 inches from the substrate when the frame 141 is held in an orientation parallel to the substrate. Wheels 147 are preferably mounted at least 1 inch from the outside edge of the frame 141 so that the device 100 may be drawn adjacent a wall or layer of extruded fluid without rolling in the wet fluid. The individual wheels 147 should be wide enough to avoid damaging the substrate. The specific width of the wheels 147 will depend upon the weight of the device 100 and the nature of the substrate. In a preferred embodiment adapted for spreading cold process bituminous adhesive on bituminous roofing sheets, the wheels 147 are about 2 to 3 inches wide.

Figure 8:
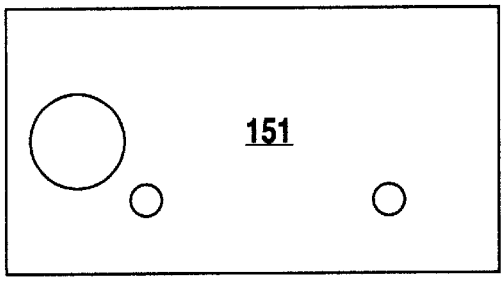
FIG. 8 shows a front view of a side plate in accordance with a preferred embodiment of the present invention.
Figure 9:
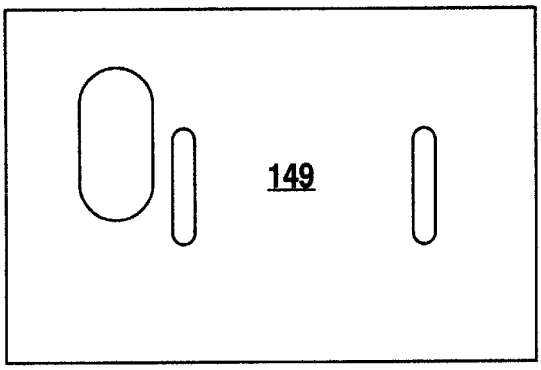
FIG. 9 shows a front view of a side shield in accordance with a preferred embodiment of the present invention.

Side plates 151 and side shields 149 are removably coupled to the exterior sides of the frame 141. The side shields 149 extend the entire length of the sides of the frame 141 and extend past the bottom of the frame 141 enough that when the frame 141 is held in a position roughly parallel to the substrate, the entire bottom edge of each side shield 149 contacts the substrate. The side shields 149 are preferably adjustably and removably mounted on the frame 141 to enable adjustment and/or replacement to correct for wear on the shields 149. The shields 149 are preferably made from a material firm enough to prevent the fluid from flowing past them and yet resilient enough to accommodate irregularities in the substrate surface. In a preferred embodiment, the side shields 149 are made from neoprene rubber about 0.25 to 0.6 inches thick. An exemplary side plate 151 is shown in FIG. 8. An exemplary side shield 149 is shown in FIG. 9.

One or more extrusion tubes 121 are preferably removably mounted on the interior of the frame 141. In a preferred embodiment of the present invention, there is one extrusion tube 121 coupled to each feed tube 127 by connector 143. Alternatively, there may be a single extrusion tube 173 with individual compartments 174 for each feed tube 127. To ensure uniform and consistent extrusion, each extrusion tube 121, or compartmentalized section thereof, should be no longer than about 12 to 15 inches, depending upon the viscosity of the fluid to be applied. For spreading cold process bituminous adhesives, each extrusion tube 121, or compartmentalized section thereof, should be no longer than about 15 inches. This is an important element of the invention as it has been found that limiting the length of the extrusion tubes 121, or the individual compartments 174 thereof, improves the uniformity and consistency of the layer of extruded fluid. The ends of the extrusion tubes 121 are preferably closed by removable plugs 163 to permit disassembly and cleaning.

Each extrusion tube 121 has means for extruding the fluid onto the substrate. In a preferred embodiment, the extrusion means comprises a plurality of holes 165 spaced equidistantly along the bottom length of the extrusion tube 121. The size, number and spacing of the holes 165 depends upon the viscosity of the fluid, the pressure in the system and the rate at which the user wishes to extrude the fluid. Alternatively, the extrusion means include, without limitation, one or more longitudinal openings, spray nozzles, and the like.

Coupled to the exterior trailing edge of the frame 141 is a squeegee clamp 145. The squeegee clamp 145 is adapted to securely, removably and adjustably couple the squeegee 123 to the frame 141 such that the squeegee 123 extends past the bottom of the frame 141 enough that when the frame 141 is held in a position roughly parallel to the substrate, the bottom edge of the squeegee 123 contacts the substrate. In a preferred embodiment, the squeegee clamp 145, comprises two flat metal plates spaced apart and coupled to one another at the top and having a plurality of holes therethrough. The squeegee 123 is secured between the plates by bolts or other suitable fasteners that pass through the plates and draw the plates together when tightened. The squeegee 123 is made from a material firm enough to spread the fluid in the desired thickness and resilient enough to accommodate irregularities in the surface of the substrate. In a preferred embodiment, the squeegee 123 is made from neoprene rubber and is about 0.25 inches thick.

Figure 4:
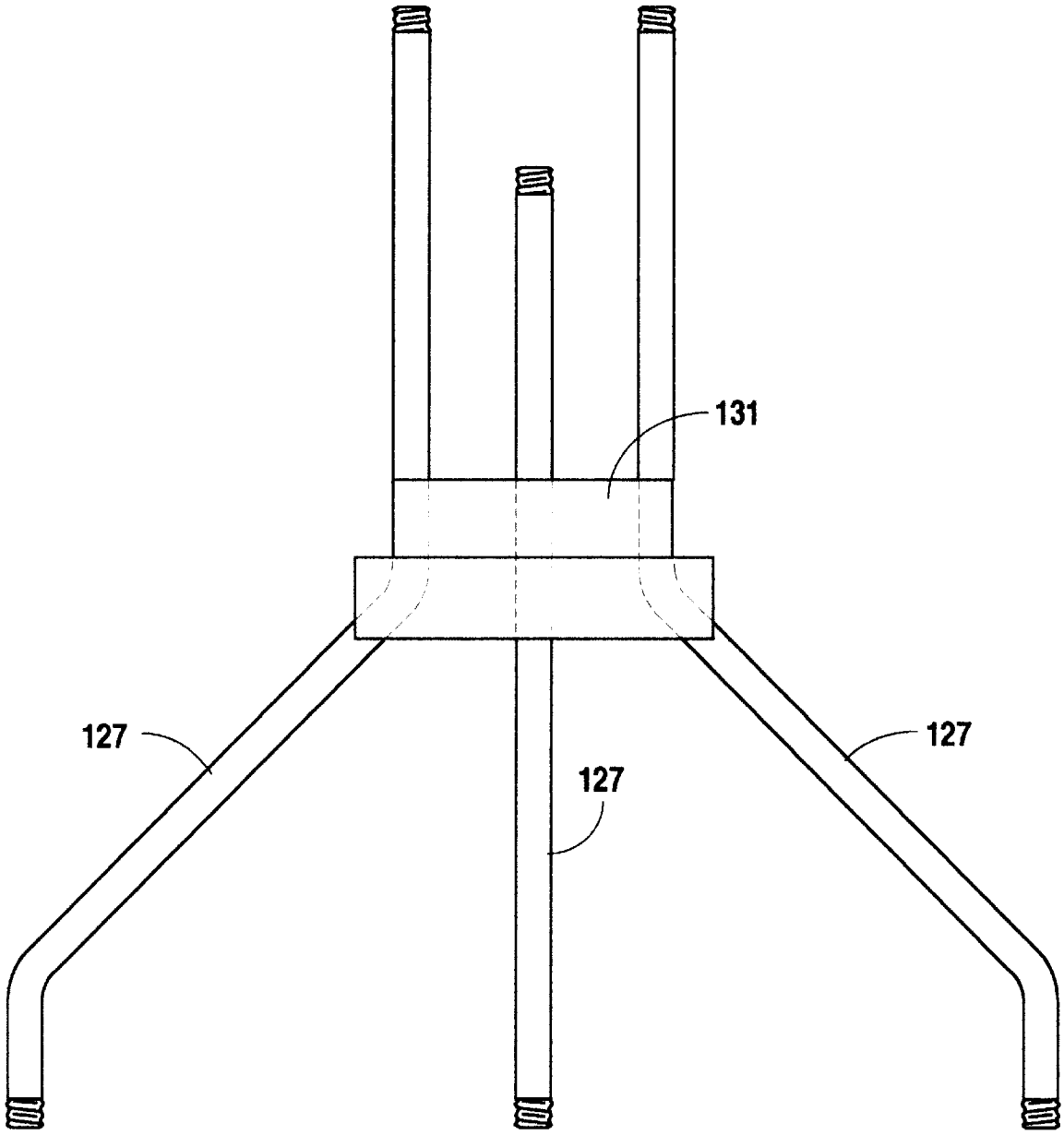
FIG. 4 shows an enlarged top view of a tube assembly portion of a coating applicator in accordance with a preferred embodiment of the present invention.
Figure 5A:
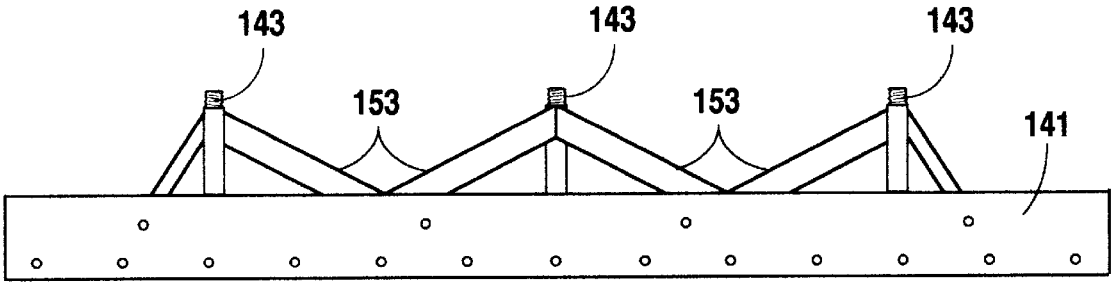
FIGS. 5A–5D show front, top, side and rear views, respectively, of an extrusion assembly portion of a coating applicator in accordance with a preferred embodiment of the present invention.
Figure 5B:
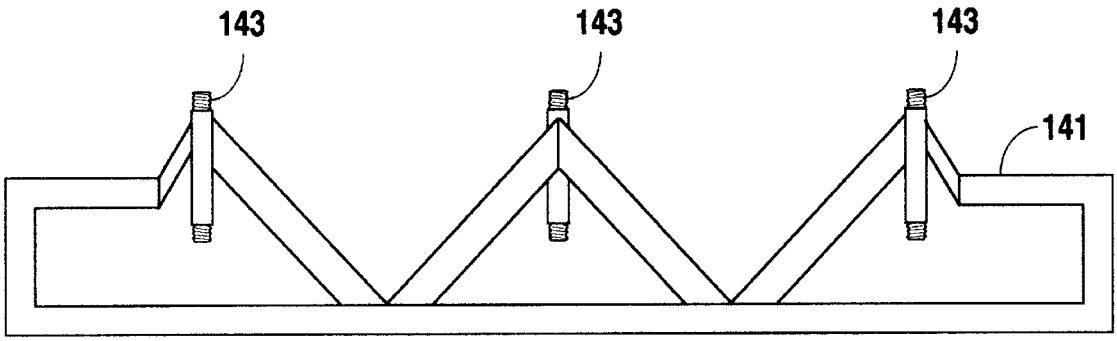
Figure 5C:
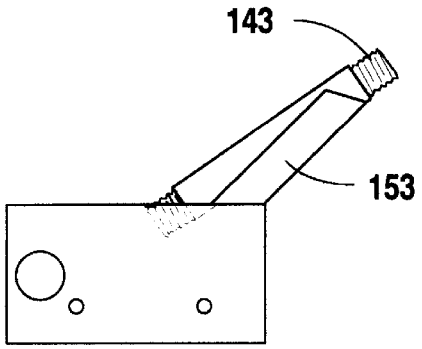
Figure 5D:
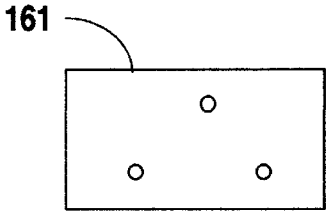
Figure 6A:
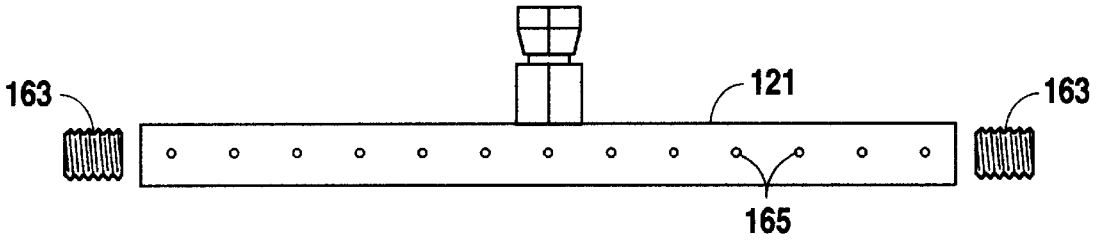
FIG. 6A shows a bottom view of a central extrusion tube of a coating applicator in accordance with a preferred embodiment of the present invention.
Figure 6B:
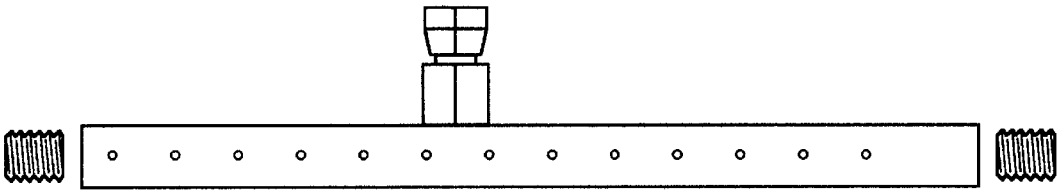
FIGS. 6B and 6C show bottom views of outer extrusion tubes of a coating applicator in accordance with a preferred embodiment of the present invention.
Figure 6C:
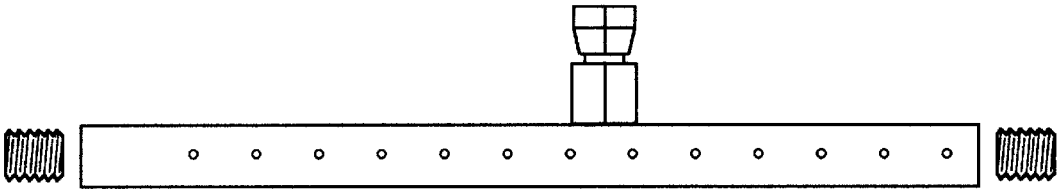
Figure 6D:
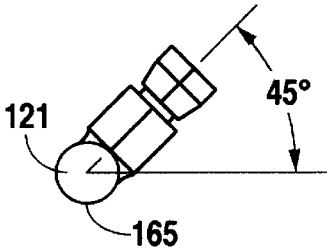
FIG. 6D shows a side view of an extrusion tube of a coating applicator in accordance with the present invention.
Figure 7B:
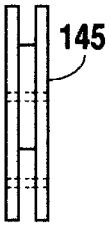
FIGS. 7A–7B show front and side views, respectively, of a squeegee clamp of a coating applicator in accordance with a preferred embodiment of the present invention.
Figure 7A:
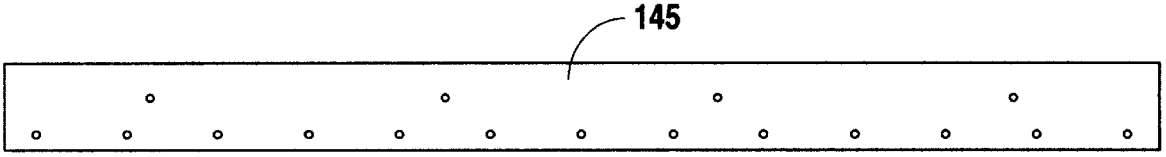

As will be appreciated by one of ordinary skill in the art, devices in accordance with the present invention may be made in a broad range of sizes and configurations depending upon the specific coating application contemplated. For the purpose of spreading cold process bituminous adhesive on prefabricated bituminous roof membranes which typically are manufactured in rolls about 3 to 3.28 feet wide, the device 100 preferably has the following specifications. The device 100 comprises 3 feed tubes 127. The central feed tube 127 is straight and the outer feed tubes 127 are bent as shown in FIGS. 1, 2 and 4. The bend in the outer feed tubes 127 should be gradual enough so as not to impede the flow of fluid through the tubes 127. The tubes 127 are made from cold roll steel tubing of about 0.218 inch wall thickness, with an outside diameter of about 0.840 inches and an inside diameter of about 0.622 inches. The feed tube connectors 143 are each about 6 inches long and of the same diameter and thickness as the feed tubes 127. Each feed tube 127 is coupled by a feed tube connector 143 to an extrusion tube 121. The central extrusion tube 121 is about 13 inches long. The outer extrusion tubes 121 are about 14 inches long. Each extrusion tube 121 has an inner diameter of about 0.622 inches, an outer diameter of about 0.840 inches and a wall thickness of about 0.218 inches. Formed in the side of each extrusion tube 121 are 13 holes 165 spaced about 1 inch apart beginning, in the central extrusion tube 121, about ½ inch from each end of the central extrusion tube 121 and about 1.5 inches from the outer end and 0.5 inches from the inner end of the outer extrusion tubes 121. Each hole 165 is about 5/32 inches in diameter. The extrusion tubes 121 are mounted on the interior of the extrusion frame 141 such that the holes 165 are positioned about 1.5 inches from the substrate. The extrusion frame 141 is about 40 inches wide, 5.5 inches deep and 3 inches high. The wheels 147 are about 2 to 3 inches wide and are mounted in such a position and are of such a diameter that when the frame 141 is held roughly parallel to the substrate, the bottom edge of the frame 141 is about 0.375 to 0.75 inches from the substrate. The side plates 151, side shields 149 and squeegee 123 are of sufficient dimensions to completely cover the sides and trailing edge of the frame 141.

In operation, the device 100 is used as follows:

(1) With all of the valves 135 and 137 in the closed position, a fluid source 171 is connected to the fluid source connecter 125 by a hose 170;

(2) The user may then open both the main valve 135 and the secondary valves 137. Optionally, the user may choose to keep one or more of the secondary valves 137 closed or partially closed so as to reduce the amount of fluid applied in the vicinity of the corresponding extrusion tube 121.

(3) With some or all of the valves open, the user draws the device 100 across the substrate by pulling handle 167;

(4) As the user proceeds across the substrate, fluid is extruded from the extrusion tubes 121 and is spread in a uniform and consistent layer by squeegee 123. Fluid is prevented from seeping past the sides of the frame 141 by side shields 149;

(5) The process is repeated on a row by row basis with the device 100 slightly overlapping the adjacent row to ensure complete, uniform coverage.

It will be understood that various changes in the details, materials and arrangements of the parts which have been described and illustrated in order to explain the nature of this invention may be made by those skilled in the art without departing from the principle and scope of the invention as expressed in the following claims.

What is claimed is:

1. A device for applying a fluid coating, comprising:

a feed tube assembly comprising a plurality of feed tubes and valves for controlling the flow of fluid through each of the tubes;

an extrusion tube coupled to each feed tube;

a fluid spreader in fluid communication with the extrusion tubes;

an extrusion frame, having a leading edge, a trailing edge and two sides, wherein the extrusion frame is coupled to the feed tube assembly, and the extrusion tubes and fluid spreader are removably coupled to the extrusion frame; and a side shield mounted on each side of the extrusion frame.

2. The device of claim 1, wherein the feed tubes and extrusion tubes are removably coupled to the device.

3. The device of claim 1, wherein the ends of the extrusion tubes are closed by removable plugs.

4. The device of claim 3, further comprising a valve cover plate covering the plurality of valves and forming a handle.

5. The device of claim 1, wherein the fluid spreader is a resilient squeegee.

6. A device for applying a fluid coating, comprising:

a feed tube assembly comprising a plurality of feed tubes and valves for controlling the flow of fluid through each of the tubes;

an extrusion tube coupled to each feed tube;

a fluid spreader in fluid communication with the extrusion tubes;

an extrusion frame, having a leading edge, a trailing edge and two sides, wherein the extrusion frame is coupled to the feed tube assembly, and the extrusion tubes and fluid spreader are removably coupled to the extrusion frame;

at least one wheel mounted on the extrusion frame;

a side shield mounted on each side of the extrusion frame; and a valve cover plate covering the plurality of valves;

wherein the feed tubes and extrusion tubes are removably coupled to the device, the ends of the extrusion tubes are closed by removable plugs, and the fluid spreader is a resilient squeegee.

7. The device of claim 6, wherein the valve cover plate forms a handle.

* * * * *